US009833668B2

(12) United States Patent
Chen et al.

(10) Patent No.: US 9,833,668 B2
(45) Date of Patent: Dec. 5, 2017

(54) CASTING AND PRESSING METHOD FOR MANUFACTURING A GOLF CLUB HEAD HAVING AN EMBEDDED HETEROGENEOUS MATERIAL

(71) Applicant: FUSHENG PRECISION CO., LTD., Taipei (TW)

(72) Inventors: Yi-Wen Chen, Taipei (TW); Ming-Jui Yang, Taipei (TW)

(73) Assignee: Fusheng Precision Co., Ltd., Taipei (TW)

( * ) Notice: Subject to any disclaimer, the term of this patent is extended or adjusted under 35 U.S.C. 154(b) by 153 days.

(21) Appl. No.: 14/806,712

(22) Filed: Jul. 23, 2015

(65) Prior Publication Data

US 2016/0121177 A1 May 5, 2016

(30) Foreign Application Priority Data

Oct. 31, 2014 (TW) ..... 103137881 A

(51) Int. Cl.

| | |
|---|---|
| ***A63B 53/04*** | (2015.01) |
| ***B22D 19/00*** | (2006.01) |
| ***C23C 8/02*** | (2006.01) |
| ***C23C 8/20*** | (2006.01) |
| ***C23C 4/18*** | (2006.01) |
| ***C23C 8/22*** | (2006.01) |
| ***C23C 4/11*** | (2016.01) |
| ***C23C 4/134*** | (2016.01) |
| *C21D 7/10* | (2006.01) |

(52) U.S. Cl.

CPC ..... *A63B 53/047* (2013.01); *B22D 19/00* (2013.01); *B22D 19/0081* (2013.01); *C23C 4/11* (2016.01); *C23C 4/134* (2016.01); *C23C 4/18* (2013.01); *C23C 8/20* (2013.01); *C23C 8/22* (2013.01); *C21D 7/10* (2013.01)

(58) Field of Classification Search

CPC ..... A63B 53/047; C23C 8/22; C23C 4/11; C23C 4/134; C23C 4/18; C23C 8/20; B22D 19/0081; B22D 19/00; C21D 7/10

See application file for complete search history.

(56) References Cited

FOREIGN PATENT DOCUMENTS

| | | |
|---|---|---|
| JP | 8322971 | * 12/1996 |
| TW | 288346 | 10/1996 |

(Continued)

*Primary Examiner* — John C Hong

(74) *Attorney, Agent, or Firm* — Alan D. Kamrath; Kamrath IP Lawfirm, P.A.

(57) ABSTRACT

A method for manufacturing a golf club head having an embedded heterogeneous material includes preparing a shell mold having a cavity and a functional member embedded into the shell mold via an embedded portion, filling the cavity with a metal liquid to completely dip the non-embedded portion of the functional member in the metal liquid; breaking the shell mold to obtain a cast product, separating the golf club head cast member from the cast product to obtain a semi-finished golf club head having a casting material and a heterogeneous material, and pressing the casting material of the semi-finished golf club head to securely engage the casting material with the heterogeneous material. The functional member includes a non-embedded portion connected to the embedded portion and located in the cavity. The cast product includes a golf club head cast member.

9 Claims, 9 Drawing Sheets

(56) References Cited

FOREIGN PATENT DOCUMENTS

| | | | |
|---|---|---|---|
| TW | 200709829 | A | 3/2007 |
| TW | M355110 | U | 4/2009 |
| TW | 200918126 | A | 5/2009 |

* cited by examiner

CASTING AND PRESSING METHOD FOR MANUFACTURING A GOLF CLUB HEAD HAVING AN EMBEDDED HETEROGENEOUS MATERIAL

CROSS REFERENCE TO RELATED APPLICATIONS

The application claims the benefit of Taiwan application serial No. 103137881, filed Oct. 31, 2014, the subject matter of which is incorporated herein by reference.

BACKGROUND OF THE INVENTION

1. Field of the Invention

The present invention generally relates to a method for manufacturing a golf club head and, more particularly, to a casting and pressing method for manufacturing a golf club head having an embedded heterogeneous material which provides an enhanced engagement between the heterogeneous material and a cast material different from the heterogenous material.

2. Description of the Related Art

To meet the requirements of a low and deep gravity center, to reduce the reactive force acted upon the user when hitting the golf ball, and to improve the feeling of the user hitting the golf ball, a golf club head is embedded with a heterogeneous material that is different from the material of the golf club head in order to adjust the gravity center and the hitting feeling. The heterogeneous material is usually arranged on the toe, sole, heel back, hosel or striking faceplate of the golf club head.

Please refer to FIG. 1. A conventional method for manufacturing a golf club head having an embedded heterogeneous material includes preparing a striking faceplate 91, forming a protruded edge 911 that protrudes from an end of the striking faceplate 91, and welding two nuts 92 to a rear face of the striking faceplate 91. The conventional method for manufacturing the golf club head further includes forming two screwed holes 931 on a surface of a counter weight 93, aligning each screwed hole 931 with a respective nut 92, and fastening the aligned screw hole 931 and nut 92 with a screw 94. Thus, the counter weight 93 is engaged with the striking faceplate 91. As shown in FIG. 2, a club head body 95 is cast by a dewax method, and the protruded edge 911 of the striking faceplate 91 is embedded in the cast club head body 95. The counter weight 93 is enclosed and installed in a space jointly defined by the club head body 95 and the striking faceplate 91, forming a golf club head 9. Such a conventional method for manufacturing a golf club head having an embedded heterogeneous material can be seen in Taiwan Patent No. 288346.

Before the club head body 95 is formed by casting, the shell mold used in the casting procedure needs to be heated to a high temperature in order to maintain the flowability of a molten metal liquid that was poured into the shell mold. However, since the striking faceplate 91, the counter weight 93 and the club head body 95 are made of different materials (i.e. the melting points of the striking faceplate 91 and the counter weight 93 are higher than that of the club head body 95), the heterogeneous materials (i.e. the striking faceplate 91 and the counter weight 93) in the shell mold are easily oxidized during the heating process of the shell mold. Thus, the engagement strength between the casting material and the heterogeneous materials is reduced. In addition, since the casting material and the heterogeneous materials have different thermal expansion coefficients, the casting material may disengage from the heterogeneous materials when cooling down.

In light of the above, it is necessary to improve the conventional method for manufacturing the golf club head having the embedded heterogeneous material.

SUMMARY OF THE INVENTION

It is therefore the objective of this invention to provide a casting and pressing method for manufacturing a golf club head having an embedded heterogeneous material which enhances the engagement between the heterogeneous material and a cast material different from the heterogenous material.

The present invention provides a casting and pressing method for manufacturing a golf club head having an embedded heterogeneous material including preparing a shell mold having a cavity inside the shell mold and a functional member embedded into the shell mold via an embedded portion, filling the cavity with a metal liquid to completely dip the non-embedded portion of the functional member in the metal liquid; breaking the shell mold to obtain a cast product after the metal liquid in the cavity completely solidifies, separating the golf club head cast member from the cast product to obtain a semi-finished golf club head having a casting material and a heterogeneous material embedded in the casting material, and pressing the casting material of the semi-finished golf club head to securely engage the casting material with the heterogeneous material. The functional member includes a non-embedded portion connected to the embedded portion and located in the cavity. The cast product includes a golf club head cast member. Furthermore, the heterogeneous material is the functional member.

In a form shown, the casting and pressing method for manufacturing the golf club head having the embedded heterogeneous material further includes trimming an outer surface of the golf club head cast member after separating the golf club head cast member from the cast product. In addition, trimming the outer surface of the golf club head cast member includes partially removing the functional member from the golf club head cast member to obtain the semi-finished golf club head, and the heterogeneous material is a remaining part of the functional member that is not trimmed off the golf club head cast member.

In the form shown, trimming the outer surface of the golf club head cast member includes completely removing the embedded portion of the functional member from the golf club head cast member to prohibit the heterogeneous material from protruding from the outer surface of the semi-finished golf club head.

Alternatively, trimming the outer surface of the golf club head cast member includes partially removing the embedded portion from the golf club head cast member to allow the heterogeneous material to partially protrude from the outer surface of the semi-finished golf club head.

In the form shown, the embedded portion of the functional member comprises an enlarged portion having a maximal cross section larger than a cross section of a part of the embedded portion adjacent to the non-embedded portion.

In the form shown, pressing the casting material of the semi-finished golf club head comprises applying a pressure of 90-200 ton/cm$^2$ to the semi-finished golf club head.

In the form shown, the casting and pressing method for manufacturing the golf club head having the embedded heterogeneous material further includes forming an anti-oxidation layer on an outer surface of the functional member to allow at least the non-embedded portion of the functional member to be covered by the anti-oxidation layer, before preparing the shell mold.

In the form shown, forming the anti-oxidation layer includes applying antioxidant to the outer surface of the functional member to form the anti-oxidation layer after the antioxidant becomes dry or carburizing the functional member to form a carburization layer as the anti-oxidation layer. Alternatively, forming the anti-oxidation layer includes applying an yttria-partially stabilized zirconia layer having a thickness of 0.05-5 mm to the outer surface of the functional member by atmospheric plasma spraying, melting the yttria-partially stabilized zirconia layer on the functional member by yttrium aluminum garret laser surface heat treatment, and rapidly cooling and solidifying the yttria-partially stabilized zirconia layer to form the anti-oxidation layer.

In the casting and pressing method for manufacturing the golf club head having the embedded heterogeneous material of the present invention, the engagement between the heterogeneous material and the casting material is enhanced by the process of casting the golf club head cast member having the embedded heterogeneous material in combination with the pressing process. As such, the casting material and the heterogeneous material can be securely engaged with each other after cooling without any loosening after a long time of use.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 5:
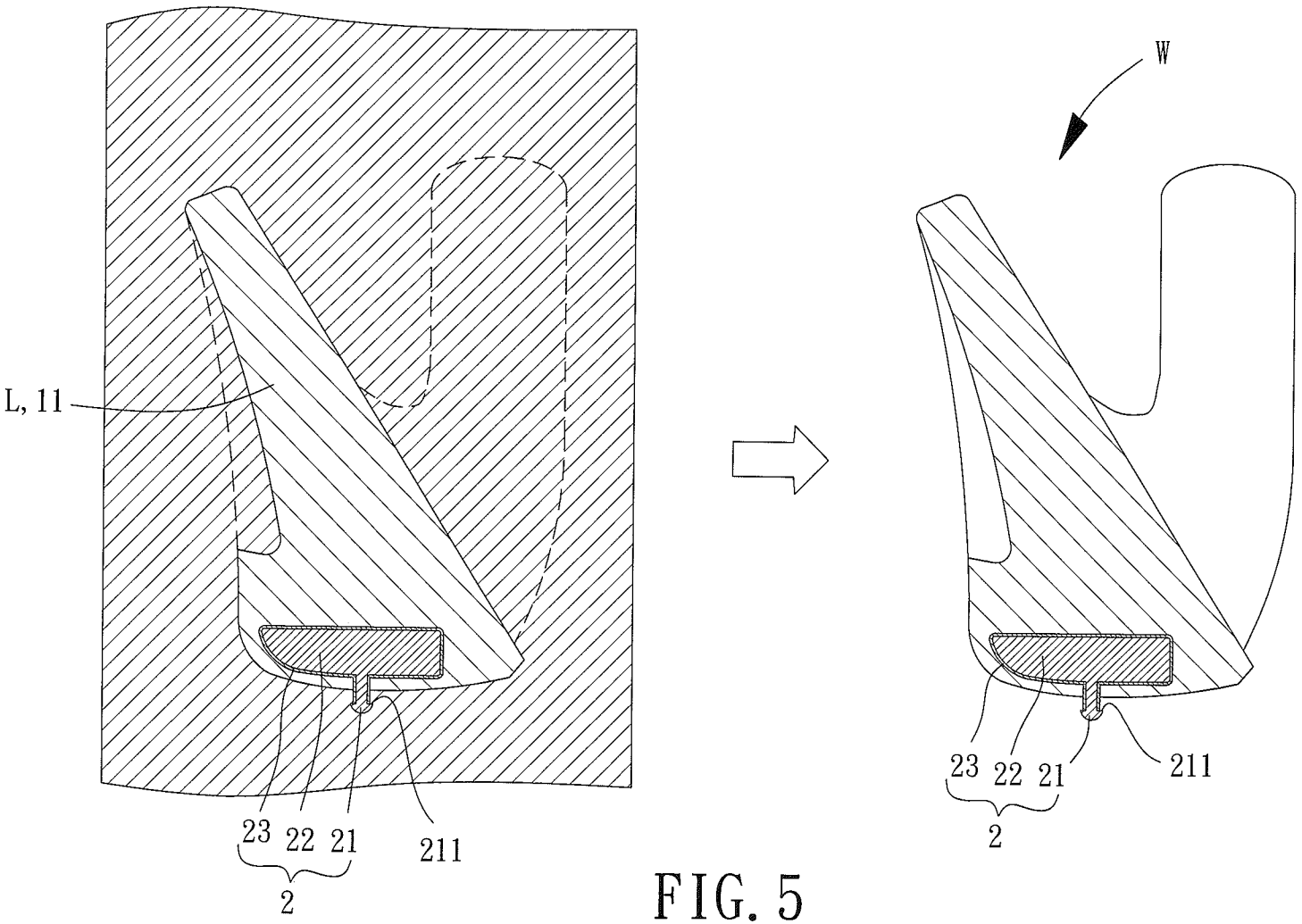

The left part of FIG. 5 is a cross sectional view of the shell mold used in the casting and pressing method for manufacturing the golf club head having the embedded heterogeneous material of the present invention, with its cavity filled by a metal liquid. The right part of FIG. 5 is a golf club head cast member having an embedded counter weight which is manufactured according to the casting and pressing method for manufacturing the golf club head having the embedded heterogeneous material of the present invention.

Figure 6:
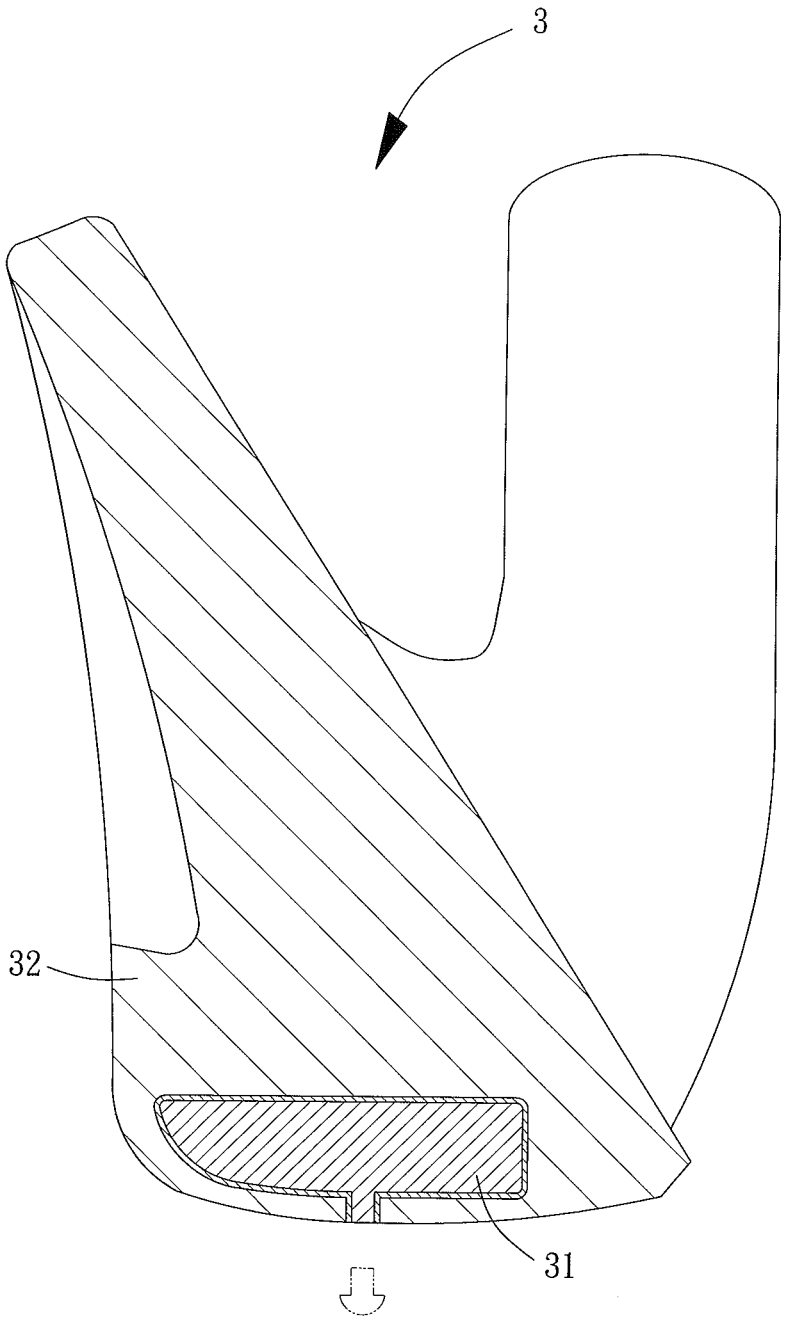

FIG. 6 is a cross sectional view of the golf club head cast member having the embedded counter weight that is trimmed according to the casting and pressing method for manufacturing the golf club head having the embedded heterogeneous material of the present invention.

Figure 7:
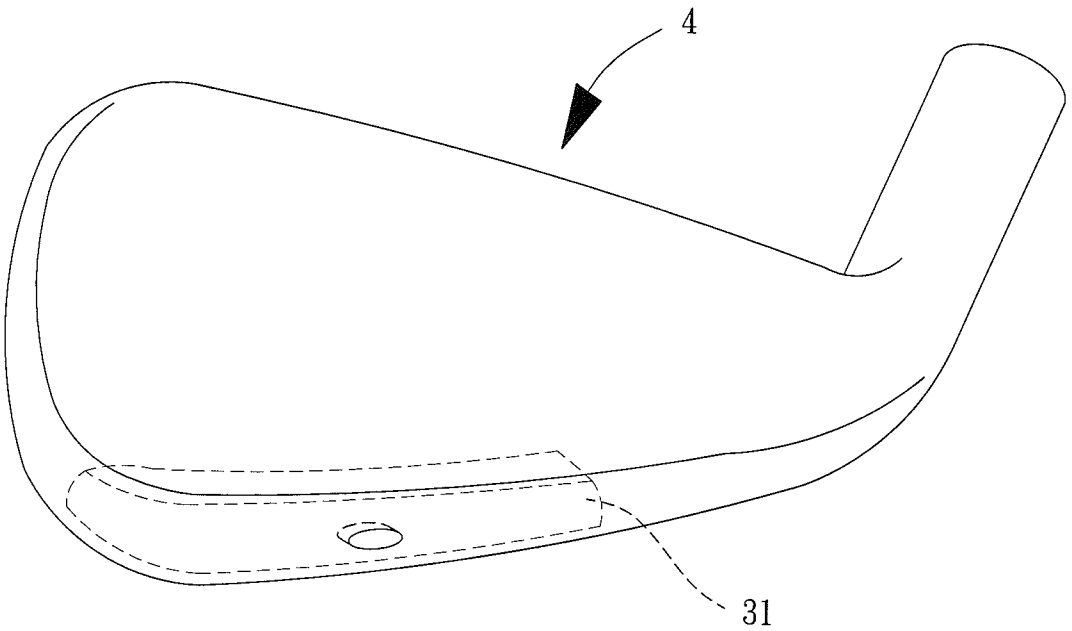

FIG. 7 is a perspective view of a golf club head product having the embedded counter weight which is pressed according to the casting and pressing method for manufacturing the golf club head having the embedded heterogeneous material of the present invention.

Figure 8:
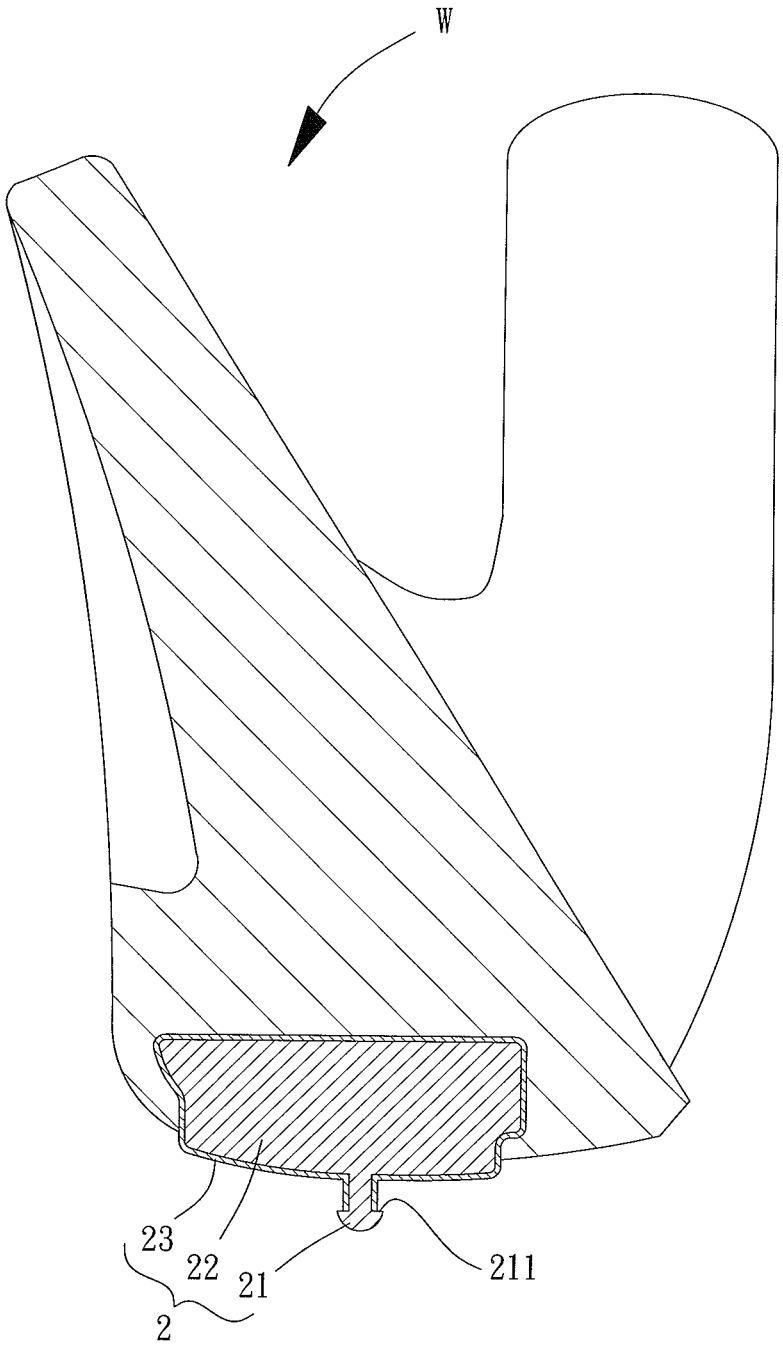

FIG. 8 is a cross sectional view of a golf club head cast member having an exposed counter weight that is obtained according to the casting and pressing method for manufacturing the golf club head having the embedded heterogeneous material of the present invention.

Figure 9:
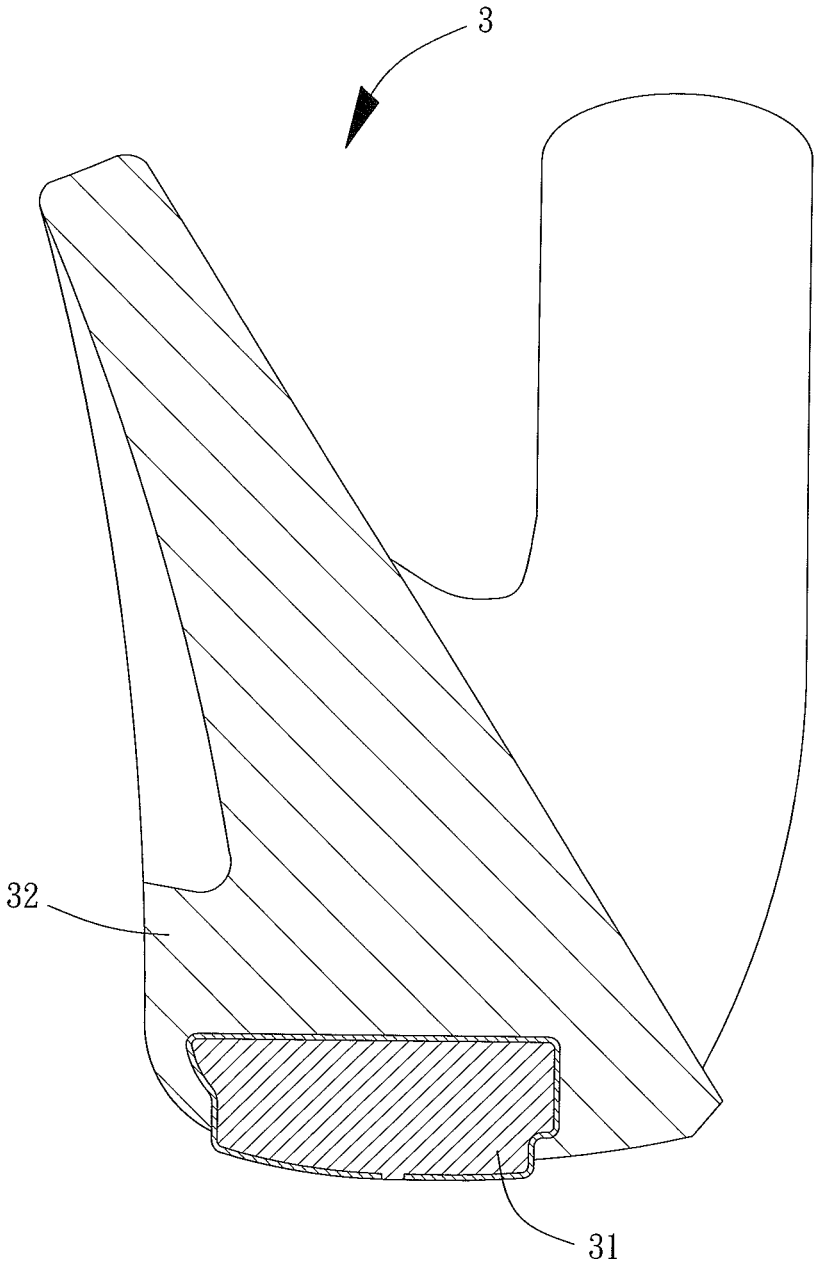

FIG. 9 is a cross sectional view of the golf club head cast member having the exposed counter weight that is trimmed according to the casting and pressing method for manufacturing the golf club head having the embedded heterogeneous material of the present invention.

Figure 10:
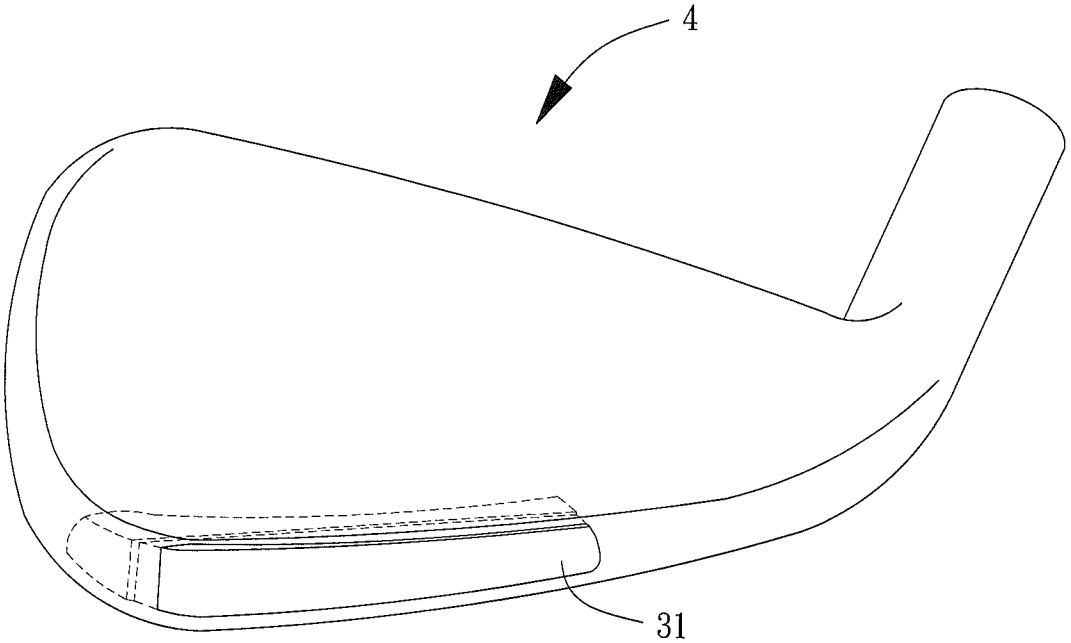

FIG. 10 is a cross sectional view of the golf club head product having the exposed counter weight that is manufactured according to the casting and pressing method for manufacturing the golf club head having the embedded heterogeneous material of the present invention.

Figure 11:
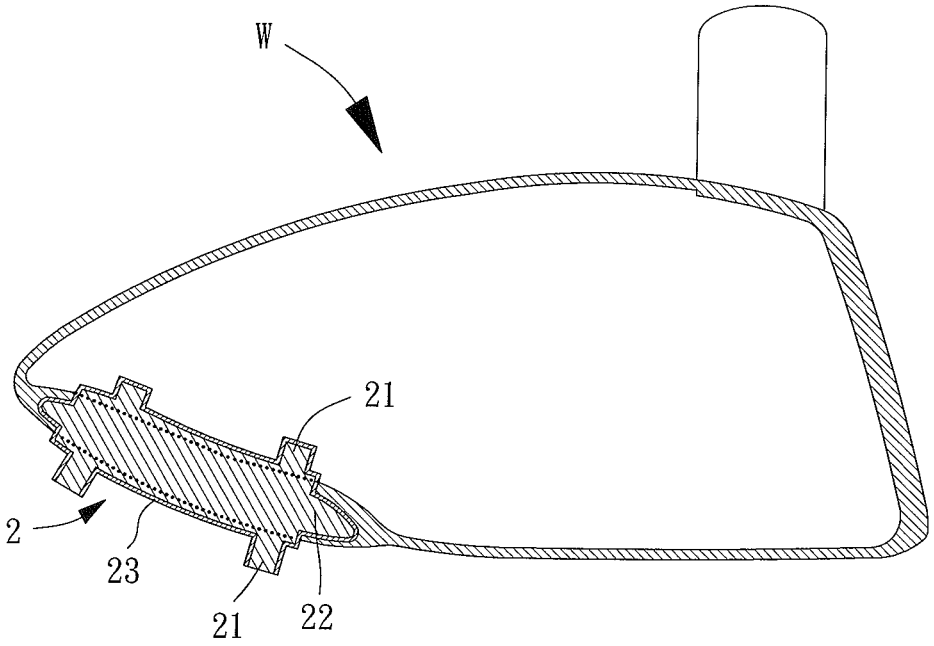

FIG. 11 is a cross sectional view of a golf wood club head cast member having an exposed counter weight that is manufactured according to the casting and pressing method for manufacturing the golf club head having the embedded heterogeneous material of the present invention.

Figure 12:
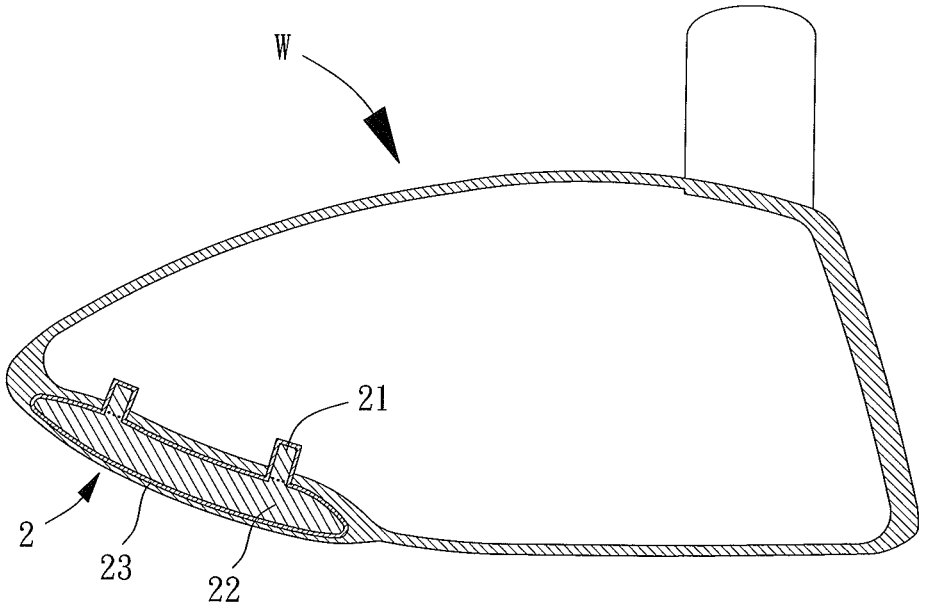

FIG. 12 is a cross sectional view of a golf wood club head cast member having an embedded counter weight that is manufactured according to the casting and pressing method for manufacturing the golf club head having the embedded heterogeneous material of the present invention.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

A casting and pressing method for manufacturing a golf club head having an embedded heterogeneous material of the present invention includes the following steps.

Figure 2:
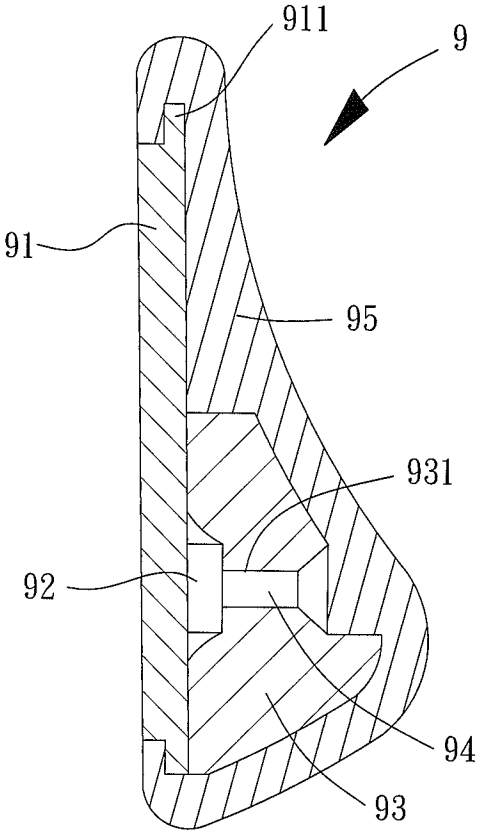
FIG. 2 PRIOR ART
FIG. 2 is a cross sectional view of a club head body cast according to the conventional method for manufacturing the golf club head having the embedded heterogeneous material, with a protruded edge of the striking faceplate and the counter weight embedded in the golf club head.
Figure 1:
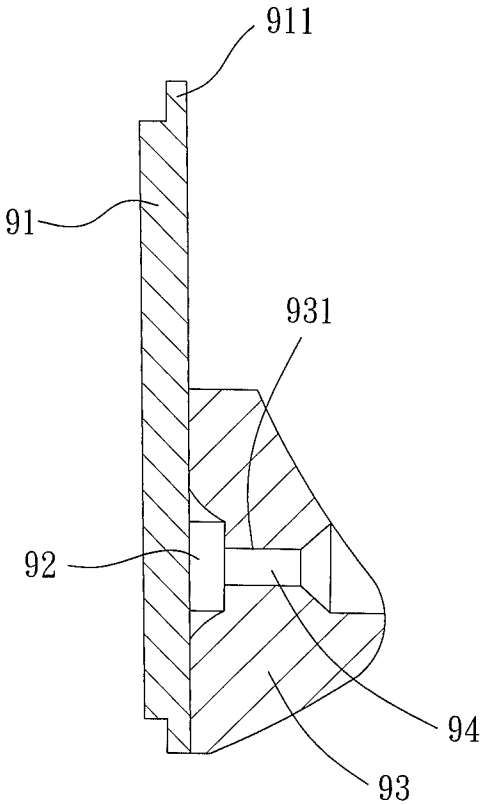
FIG. 1 PRIOR ART
FIG. 1 is a cross sectional view of a counter weight engaged with a striking faceplate that is manufactured according to a conventional method for manufacturing a golf club head having an embedded heterogeneous material.
Figure 3:
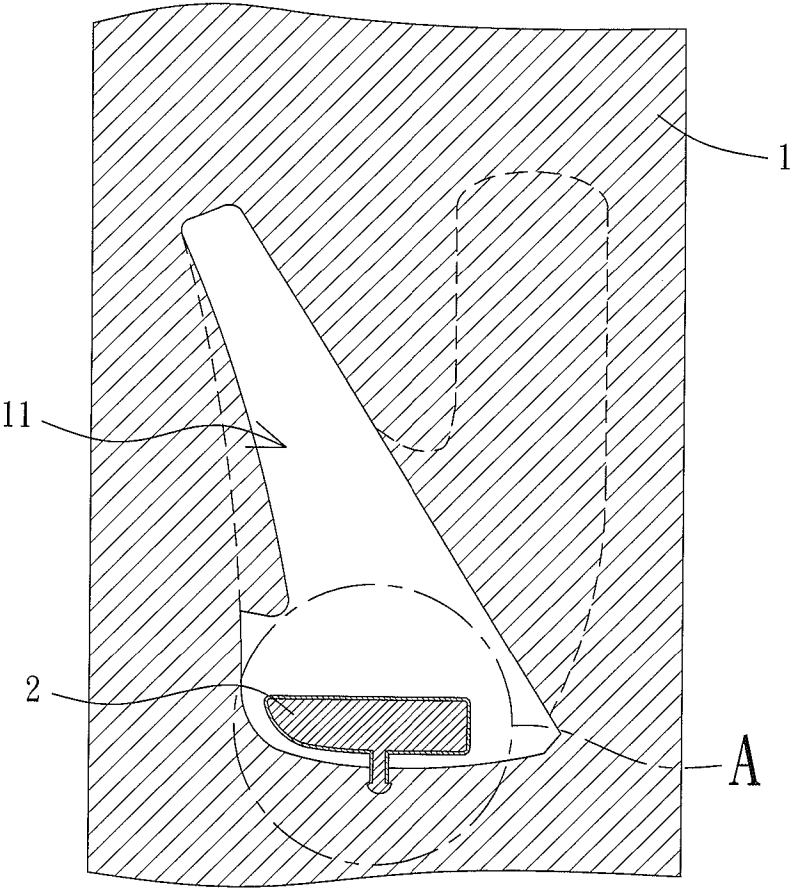
FIG. 3 is a cross sectional view of a shell mold used in a casting and pressing method for manufacturing a golf club head having an embedded heterogeneous material of the present invention.
Figure 4:
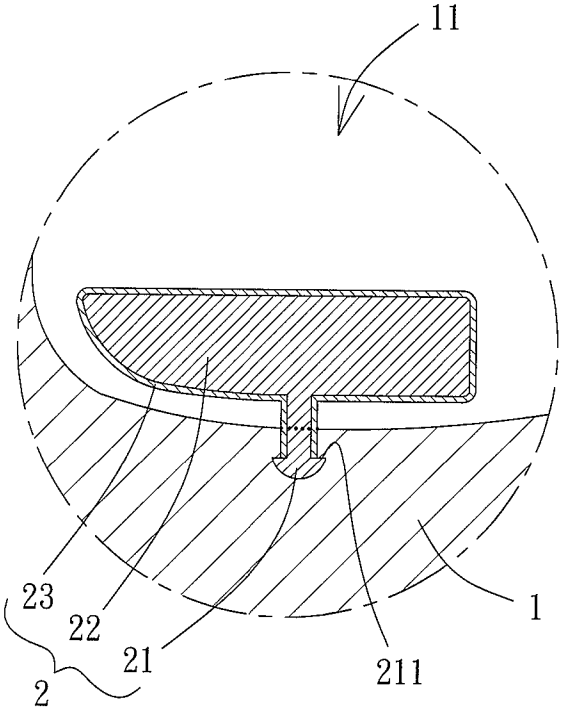
FIG. 4 is a cross sectional view of a part "A" of FIG. 3.

Please refer to FIGS. 3 and 4 which show the steps of preparing a shell mold 1 and forming a cavity 11 inside the shell mold 1. A functional member 2 is received in the cavity 11 with a part of the functional member 2 embedded in the shell mold 1. The shape and location of the functional member 2 is not limited in the present invention. In this embodiment, the functional member 2 is a counter weight arranged on the sole of an iron golf club head. However, it is not taken as a limited sense.

Specifically, the functional member 2 includes an embedded portion 21 and a non-embedded portion 22. The embedded portion 21 of the functional member 2 is embedded in the shell mold 1, and the non-embedded portion 22 is located in the cavity 11. Preferably, the embedded portion 21 may include an enlarged portion 211, with a maximal cross section of the enlarged portion 211 being larger than the cross section of the part of the embedded portion 21 adjacent to the non-embedded portion 22. Thus, the engagement between the embedded portion 21 of the functional member 2 and the shell mold 1 is enhanced, and the embedded portion 21 is prevented from disengaging from the shell mold 1.

The casting and pressing method of the present invention may further include forming an anti-oxidation layer 23 on an outer surface of the functional member 2 before the steps of preparing the shell mold 1 and embedding the functional member 2 in the shell mold 1. As an example, forming the anti-oxidation 23 may include applying antioxidant to the outer surface of the functional member 2. After the anti-oxidation layer 23 becomes dry, the injected wax is covered all around the functional member 2 to obtain the shell mold 1. According to an embodiment of the present invention, the functional member 2 may be a tungsten ingot with high density, the antioxidant may be boron nitride (BN), and the anti-oxidation layer 23 may have a thickness of 0.01-0.05 mm.

Alternatively, forming the anti-oxidation layer 23 may include carburizing the functional member 2 to partially change the constituent of the functional member 2. Thus, the functional member 2 may form a carbonized layer with a predetermined thickness on the outer surface. As an example, in the case that the functional member 2 is high-density tungsten, the anti-oxidation layer 23 may be a tungsten carbide layer with a thickness of 0.1-1.5 mm.

Alternatively, forming the anti-oxidation layer 23 may include applying an yttria-partially stabilized zirconia (Y-PSZ) layer having a thickness of 0.05-5 mm to the outer surface of the functional member 2 by atmospheric plasma spraying, melting the Y-PSZ layer that was formed on the functional member 2 by yttrium aluminum garret (YAG) laser surface heat treatment, and rapidly cooling and solidifying the Y-PSZ layer (e.g. by water cooling) to form the anti-oxidation layer 23. As such, the loose microstructure of the Y-PSZ layer becomes tight after the smelting and cooling processes, thus forming the anti-oxidation layer 23 with an enhanced microstructure and improved mechanical properties.

Please refer to FIG. 5 which shows the step of pouring a metal liquid "L" into the cavity 11 of the shell mold 1 to fill the cavity 11 of the shell mold 1. Thus, the non-embedded portion 22 of the functional member 2 located in the cavity 11 is completely dipped in the metal liquid "L." Specifically, filling the cavity 11 by the metal liquid "L" includes heating and melting at least one metal ingot into the metal liquid "L," and the metal liquid "L" is then poured into the cavity 11 of the shell mold 1 under gravity force or centrifugal force. The metal liquid "L" flows into and fills the cavity 11 of the shell mold 1, so that the non-embedded portion 22 and the anti-oxidation layer 23 of the functional member 2 are completely dipped in the metal liquid "L." When the at least one metal ingot includes a single metal ingot, the composition of the metal ingot is the same as a desired casting material of the golf club head. Alternatively, when the at least one metal ingot includes a plurality of metal ingots, the composition of the metal liquid "L" obtained from the metal ingots is the same as the desired casting material of the golf club head. In the case that the functional member 2 is D14 tungsten ingot, the metal liquid "L" can be LD745 stainless steel. Alternatively, when the functional member 2 is a tungsten ingot, the metal liquid "L" can be 450-type stainless steel.

In the case that the metal liquid "L" contains an easily-oxidized component, it is preferred to place the shell mold 1 in a vacuum furnace for controlling the level of vacuum around the shell mold 1. This prevents the appearance defects (such as sesame dots or black beans) from forming on the surface of the golf club head cast member, and even prevents the reactive gas from forming a large amount of slag holes or blow holes on the golf club head cast member, that may be caused by the fire crack that takes place when the metal liquid "L" is poured into the cavity 11.

The casting and pressing method further includes breaking the shell mold 1 to obtain a cast product after the metal liquid "L" poured in the cavity 11 of the shell mold 1 completely solidifies. The cast product includes a golf club head cast member "W." Next, the casting and pressing method also includes separating the golf club head cast member "W" from the cast product, such as cutting the golf club head cast member "W" from the cast product with a knife or breaking the golf club head cast member "W" off the cast product under a vibration force. The non-embedded portion 22 of the functional member 2 and the anti-oxidation layer 23 are embedded in the golf club head cast member "W," with the embedded portion 21 of the functional member 2 protruding out of an outer surface of the golf club head cast member "W."

Please refer to FIG. 6 which shows the step of trimming the outer surface of the golf club head cast member "W" to remove some part of the functional member 2 protruding out of the outer surface of the golf club head casting member "W" (i.e. the embedded portion 21 and a small portion of the anti-oxidation layer 23). Thus, the golf club head 3 is obtained as a semi-finished product. The semi-finished golf club head 3 includes a heterogeneous material 31, as well as a casting material 32 in which the heterogeneous material 31 is embedded. The heterogeneous material 31 is the remaining part of the functional member 2 that was not trimmed off the golf club head cast member "W" (i.e. the non-embedded portion 22 and the remained anti-oxidation layer 23).

Please refer to FIG. 7 which shows the step of pressing the casting material 32 of the semi-finished golf club head 3. Based on this, the casting material 32 is securely engaged with the heterogeneous material 31. Next, the semi-finished golf club head 3 are assembled with several required components according to needs, forming a golf club head product 4 having the embedded heterogeneous material 31. By using the heterogeneous material 31 that is different from the casting material 32, the golf club head product 4 is provided with different required functions such as a low and deep gravity center, the reduction of reactive force acted upon the user when hitting the golf ball, and the improvement to the feeling of the user hitting the golf ball.

Specifically, the pressing process may be a cool forging process carried out under room temperature after the casting material 32 completely cools down. As such, the equipment required for the pressing process is simple, and the engagement between the casting material 32 and the heterogeneous material 31 will not be deteriorate again by the environmental temperature after the pressing process. For example, the pressing process includes placing the semi-finished golf club head 3 in a lower portion of a shaping mold, and applying a shaping force to the semi-finished golf club head 3 via an upper portion of the shaping mold. In the case that the pressure used in the pressing process is lower than 90 ton/cm$^2$, the engagement between the casting material 32 and the heterogeneous material 31 is apt to be lower than the required standard. On the other hand, when the pressure is higher than 200 ton/cm$^2$, the casting material 32 may have a thickness less than the required thickness. As a conclusion, the forging process is preferably carried out under a pressing pressure of 90-200 ton/cm$^2$.

Furthermore, the pressing process may be a high-speed shaping process or a low-speed shaping process according to the portion of the golf club head requiring the forging process. The high-speed shaping process may be a forging process or a stamping process with a shortened period of time as required, thus improving the production efficiency. The low-speed shaping process may include pressing the shaping mold under oil pressure, in which the casting material 32 is shaped in a slow and stable manner under the pressing action of the shaping mold. As such, the shaping force can be uniformly applied to the cast product, thus improving product quality. In addition, the slow shaping process reduces the damage to the shaping mold, advantageously prolonging service life of the shaping mold.

Please refer to FIGS. 8-10. According to a second embodiment of the present invention, a casting and pressing method for manufacturing a golf club head having an embedded heterogeneous material may be used to produce the golf club head having a partially-exposed heterogeneous material 31. As an example, a counter weight is used as the heterogeneous material 31 and is partially exposed out of a bottom surface of the golf club head. Alternatively, the heterogeneous material 31 may be a striking faceplate for adjusting the hitting feeling of the user using the golf club head. As shown in FIG. 8, trimming the outer surface of the golf club head cast member "W", which is separated from the cast product, may include removing only a part of the embedded portion 21. Namely, a minor part of the heterogeneous material 31 is still exposed out of the outer surface of the semi-finished golf club head 3 as shown in FIG. 9. In addition, the pouring process and the pressing process are similar to those described above, and are not discussed hereinafter again.

Please refer to FIG. 11 showing a third embodiment of the present invention with the functional member 2 embedded in a golf wood club head. The functional member 2 also includes the embedded portion 21 and the non-embedded portion 22. In this embodiment, a part of the embedded portion 21 is embedded in a first portion of a shell mold that is used to form a cavity portion inside the golf wood club head. The other part of the embedded portion 21 is embedded in a second portion of the shell mold out of the golf wood club head. As such, the non-embedded portion 22 (and the anti-oxidation layer, if existing) is completely embedded in a golf club head cast member "W". Thus, a part of the embedded portion 21 is exposed to and located in the cavity portion of the golf club head cast member "W", while the other part of the embedded portion 21 is exposed out of the outer surface of the golf club head cast member "W" and needs to be trimmed off. Other manufacturing processes of this embodiment are similar to the above embodiments, as it would be understood by the persons having ordinary skill in the art.

Please refer to FIG. 12 showing a fourth embodiment of the present invention, with the functional member 2 arranged in the wood club head. This embodiment differs from the third embodiment in that the embedded portion 21 is embedded into only the first portion of the shell mold used to form the cavity portion inside the golf wood club head. As such, the functional member 2 is completely embedded in the golf club head cast member "W." Namely, the embedded portion 21 of the functional member 2 needs not be removed since it is exposed to and located in the cavity portion of the golf club head cast member "W" and will not affect the appearance of the golf club head cast member "W." Thus, a simplified manufacturing procedure is provided. Since the golf club head cast member "W" is already a semi-finished golf club head and can be forged and pressed directly, the efficiency of the manufacturing procedure is further improved.

As a conclusion, in the casting and pressing method for manufacturing the golf club head having the embedded heterogeneous material of the present invention, the engagement between the heterogeneous material and the casting material is enhanced by the process of casting the golf club head cast member having the embedded heterogeneous material in combination with the pressing process. As such, the casting material and the heterogeneous material can be securely engaged with each other after cooling without any loosening after a long time of use.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A casting and pressing method for manufacturing a golf club head having an embedded heterogeneous material comprising:

preparing a shell mold having a cavity inside the shell mold and a functional member embedded into the shell mold via an embedded portion, wherein the functional member comprises a non-embedded portion connected to the embedded portion and located in the cavity;

filling the cavity with a metal liquid to completely dip the non-embedded portion of the functional member in the metal liquid;

breaking the shell mold to obtain a cast product after the metal liquid in the cavity completely solidifies, wherein the cast product comprises a golf club head cast member;

separating the golf club head cast member from the cast product to obtain a semi-finished golf club head having a casting material and a heterogeneous material embedded in the casting material, wherein the heterogeneous material is the functional member;

pressing the casting material of the semi-finished golf club head to securely engage the casting material with the heterogeneous material; and forming an anti-oxidation layer on an outer surface of the functional member to allow at least the non-embedded portion of the functional member to be covered by the anti-oxidation layer, before preparing the shell mold.

2. The casting and pressing method for manufacturing the golf club head having the embedded heterogeneous material as claimed in claim 1, further comprising trimming an outer surface of the golf club head cast member after separating the golf club head cast member from the cast product, wherein trimming the outer surface of the golf club head cast member comprises partially removing the functional member from the golf club head cast member to obtain the semi-finished golf club head, and wherein the heterogeneous material is a remaining part of the functional member that is not trimmed off the golf club head cast member.

3. The casting and pressing method for manufacturing the golf club head having the embedded heterogeneous material as claimed in claim 2, wherein trimming the outer surface of the golf club head cast member comprises completely removing the embedded portion of the functional member from the golf club head cast member to prohibit the heterogeneous material from protruding from the outer surface of the semi-finished golf club head.

4. The casting and pressing method for manufacturing the golf club head having the embedded heterogeneous material as claimed in claim 2, wherein trimming the outer surface of the golf club head cast member comprises partially removing the embedded portion from the golf club head cast member to allow the heterogeneous material to partially protrude from the outer surface of the semi-finished golf club head.

5. The casting and pressing method for manufacturing the golf club head having the embedded heterogeneous material as claimed in claim 1, wherein the embedded portion of the functional member comprises an enlarged portion having a maximal cross section larger than a cross section of a part of the embedded portion adjacent to the non-embedded portion.

6. The casting and pressing method for manufacturing the golf club head having the embedded heterogeneous material as claimed in claim 1, wherein pressing the casting material of the semi-finished golf club head comprises applying a pressure of 90-200 ton/cm2 to the semi-finished golf club head.

7. The casting and pressing method for manufacturing the golf club head having the embedded heterogeneous material as claimed in claim 1, wherein forming the anti-oxidation layer comprises applying antioxidant to the outer surface of the functional member to form the anti-oxidation layer after the antioxidant becomes dry.

8. The casting and pressing method for manufacturing the golf club head having the embedded heterogeneous material as claimed in claim 1, wherein forming the anti-oxidation layer comprises carburizing the functional member to form a carburization layer as the anti-oxidation layer.

9. The casting and pressing method for manufacturing the golf club head having the embedded heterogeneous material as claimed in claim 1, wherein forming the anti-oxidation layer comprises:

applying an yttria-partially stabilized zirconia layer having a thickness of 0.05-5 mm to the outer surface of the functional member by atmospheric plasma spraying;

melting the yttria-partially stabilized zirconia layer on the functional member by yttrium aluminum garret laser surface heat treatment; and rapidly cooling and solidifying the yttria-partially stabilized zirconia layer to form the anti-oxidation layer.

* * * * *